US005992030A

United States Patent [19]

Mann

[11] Patent Number: 5,992,030

[45] Date of Patent: Nov. 30, 1999

[54] GUN SIGHTING ENHANCEMENT

[76] Inventor: Robert J. Mann, 17935 S.W. Lake Haven Dr., Lake Oswego, Oreg. 97035

[21] Appl. No.: 09/132,998

[22] Filed: Aug. 12, 1998

Related U.S. Application Data

[63] Continuation of application No. 08/744,540, Nov. 6, 1996.

[51] Int. Cl.[6] ..... F41G 1/02

[52] U.S. Cl. ..... 33/243; 42/100

[58] Field of Search ..... 33/243, 261; 42/100

[56] References Cited

U.S. PATENT DOCUMENTS

| | | | |
|---|---|---|---|
| 3,777,380 | 12/1973 | Theodore | 42/100 |
| 4,458,436 | 7/1984 | Bohl | 42/100 |
| 4,683,662 | 8/1987 | Kiss, Jr. | 33/233 |
| 4,993,158 | 2/1991 | Santiago | 33/253 |
| 5,174,128 | 12/1992 | Bourne et al. | 62/373 |
| 5,384,980 | 1/1995 | Johnson et al. | 42/100 |
| 5,426,882 | 6/1995 | Dornaus | 42/100 |

*Primary Examiner*—Charles T. Jordan
*Assistant Examiner*—Denise J Buckley
*Attorney, Agent, or Firm*—Robert L. Harrington

[57] ABSTRACT

A gun sight enhancement applied to the sights of a gun to aid in the visual alignment of the sights on a target. Contrasting color dots are applied to the front and rear sights of the gun. The contrasting colors between the front and rear sights enhances the visual aligning of the sights on target. A kit is provided with at least three paint colors; yellow, orange and green. The paint is a tough durable coating that remains resilient to expand and contract with the expansion and contraction of the sights.

1 Claim, 1 Drawing Sheet

GUN SIGHTING ENHANCEMENT

This application is a continuation of co-pending application Ser. No. 08/744,540 filed on Nov. 6, 1996.

FIELD OF THE INVENTION

This invention relates to aiming sights applied to rifles and pistols and more particularly relates to enhancing the visibility of such sights for increased shooting accuracy.

BACKGROUND OF THE INVENTION

Aiming sights for rifles/pistols and firearms in general (hereafter referred to collectively as guns) as contemplated for the present invention includes a pair of appendages applied to the top surface of a gun barrel. There are commonly a front sight and a rear sight and they are carefully aligned along the axis of the gun barrel. By lining up the two sights with the target, the gun barrel is aligned accordingly and a bullet propelled along the path of the barrel axis should strike the target.

Gun sights as described have existed for many decades. Whereas aligning the two sights with a target will achieve the desired accuracy, a very slight misalignment will cause a miss. It is important that a shooter be able clearly to distinguish between the front and rear sights and to place the sights in precise alignment. (One type of sight arrangement includes a U-shaped appendage at the rear end of the barrel and an I-shaped appendage at the front end. The I of the front sight is positioned precisely in the center of the U to align the barrel axis with the target.) A slight blurring of the sights, i.e., where the front and rear sights are not clearly distinguishable is a major problem for many shooters. Different individuals with varying eyesight deficiencies may not have the visual acuity needed to achieve this distinction. The present invention is directed to enhancing the visual acuity of shooters, primarily older shooters but enhancing the acuity for all types of shooters.

BRIEF DESCRIPTION OF THE INVENTION

It was discovered that applying one or both sights with color spots (to give the sights different colors) enables a shooter to more easily distinguish between the sights and provide the desired alignment. However, simply coloring one of the sights is not the complete answer. Gun barrels are subjected to extreme heat and the metal of the gun barrel expands and contracts. Initially nothing could be found that would stay on the gun sights and not rapidly wear off, or become discolored and thereby lose the color distinction.

To the best of the inventor's knowledge, he was the first to find a solution to after-market gun sight enhancement, i.e., enabling the gun owner to improve his sighting ability. A color coating was discovered that can be readily applied by the gun owner and will withstand the severe abuse subjected onto gun barrel sights. Application of the color coating to conventional gun barrel sights in the form of precise spots (certain color spots being more effective than others) has been found to achieve the desired enhanced acuity. It is long lasting, e.g., for months of constant target practice use and it has indeed become commercially acceptable.

The material used is a pure acrylic and is available under the trademark SLICK PAINT and is produced and/or marketed by Polymerics, Inc. of Waltham, Mass. Whereas the material has been available on the market primarily in craft shops and used to "paint" clothing (the paint becoming securely bonded to the cloth material while surviving multiple washings and abusive wear), it has not been heretofore considered or applied for anything resembling that of the present invention. The optimal colors for the current unique application of this material are green, orange and yellow.

Whereas the application of the color coatings is provided in the after market to gun owners who have previously purchased guns with conventional aiming sights, the product is provided in kit form with multiple colors and an applicator provided in the kit. The kit enables the shooter to try different color combinations particularly suited to his own need. For example, it is not uncommon for men in particular to suffer from varying forms of color blindness with certain color combinations being more distinguishable to a particular individual than others.

The invention will be more fully understood by reference to the following detailed description having reference to the drawings appended hereto.

DESCRIPTION OF THE PREFERRED EMBODIMENT

Figure 1:
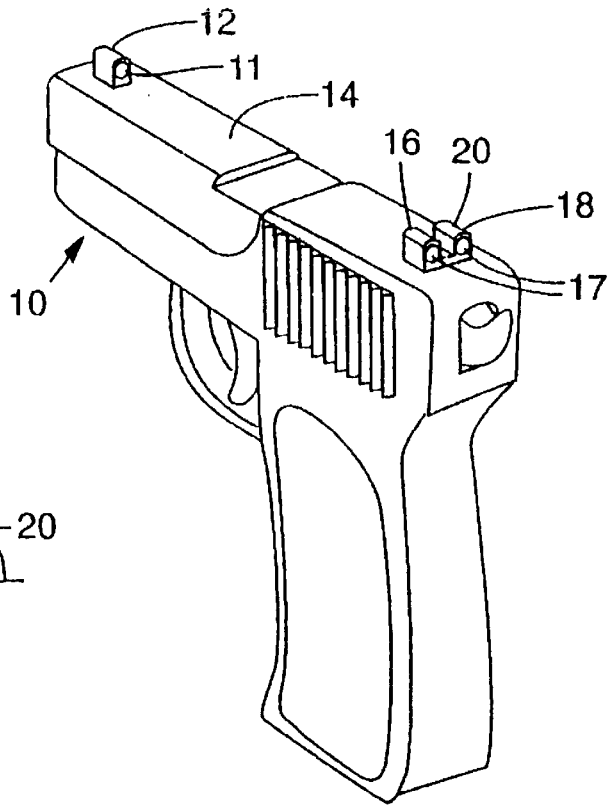
FIG. 1 is a perspective view of a gun sighting enhancement applied to sights of a hand gun in accordance with this invention.

Refer now to FIG. 1 of the drawings which illustrates a handgun 10 on which a gun sighting enhancement of the present invention has been applied. A handgun is illustrated as an example. However, the gun sighting enhancement of the present invention is equally suited to other weapons such as shotguns, rifles and the like which have a sight at the muzzle end and another sight at the grip end or stock end of the weapon. The gun sighting enhancement of the present invention aids a shooter in aligning the sights on a target.

As seen in FIG. 1, the handgun 10 has a single sight 12 at the muzzle end. The sight 12 projects above the barrel 14 of the handgun 10 and is aligned with the center point between paired projections 16 and 18 at the grip end of the handgun 10. The paired projections 16, 18 will hereafter be referred to as a sight 20. The sight 12 and the paired projections 16, 18 (sight 20) project above the barrel 14. The sight 12 and the sight 20 are further aligned with the longitudinal axis of the barrel 14.

Figure 2:
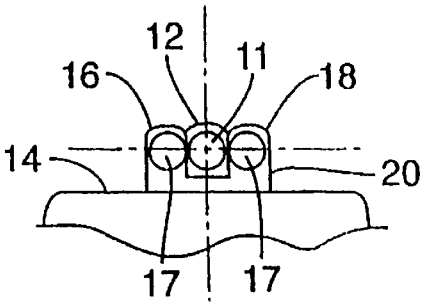
FIG. 2 is a view along the sights of the handgun of FIG. 1.

A shooter will align the sight 12 with the sight 20 to aim at a target in the manner illustrated in FIG. 2. Often, it is difficult for a shooter to adequately align the sights 12, 20 due to lighting conditions, background colors, visual acuity of the shooter and other conditions. The sights are most often of the same color or shading which adds to the difficulty of aligning the sights on a target. To enhance the capability of a shooter to align the sights 12 and 20 the gun sighting enhancement of the present invention is applied to the sights 12 and 20.

The gun sighting enhancement of the present invention is a special paint in brilliant colors applied to the sights 12 and 20. The paint is a tough durable coating, preferably of acrylic, that will aggressively bond to the sights 12, 20. The paint remains flexible throughout its life and will expand and contract with the expansion and contraction of the sights 12, 20. Having one color on the sight 12 and another color on the sight 20 is preferable. It has been found that the colors orange, yellow and green are the most beneficial for most users although other colors may be utilized, such as red and white for example.

Referring again to FIGS. 1 and 2 and as by way of example a yellow color dot designated as 11 is applied to sight 12 and an orange color dot designated as 17 is applied to each projection 16 and 18 of the sight 20. It will be appreciated that other color combinations may be utilized or the color combinations reversed. A user will select colors that are best suited to his/her use. When a user aims the gun 10 by visually aligning the sights 12, 20, (best seen in FIG. 2) the yellow color dot 11 on sight 12 will be clearly visible between the orange color dots 17 on the projections 16, 18 of the sight 20. The contrasting colors on the sights 12, 20 enables a user to accurately align the sights 12, 20 with a target. The contrasting colors on the sights 12, 20 increases the visual acuity to align the sights 12, 20.

Figure 3:
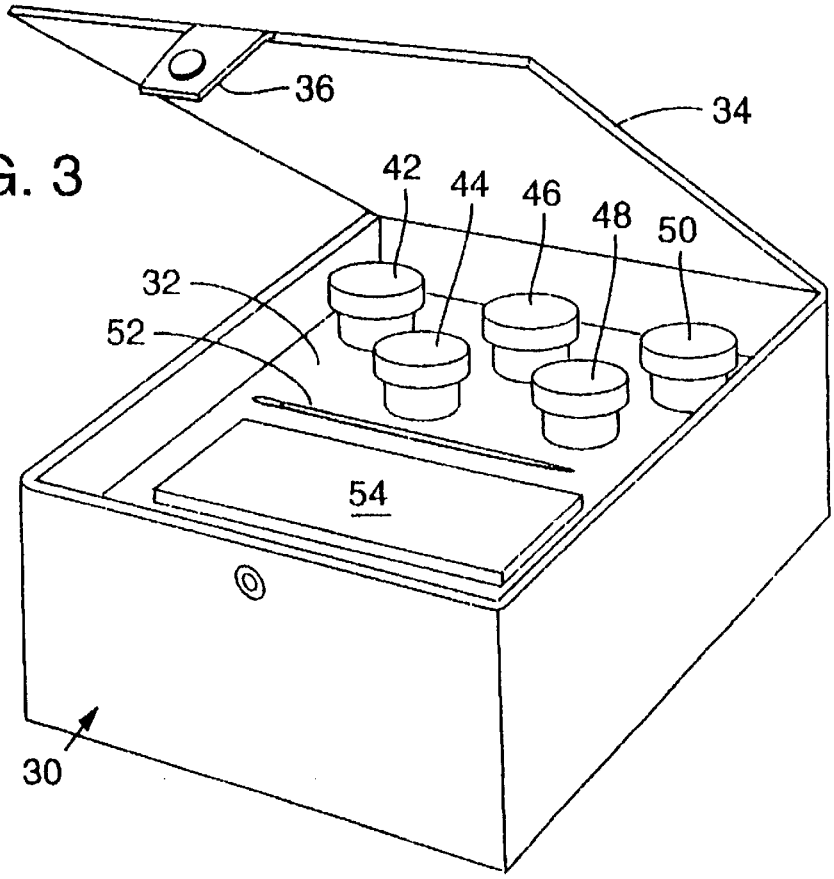
FIG. 3 is a perspective view of a gun sight enhancement kit for a user.

Refer now to FIG. 3 of the drawings which illustrates a typical gun sighting enhancing kit 30. The kit 30 has a suitable rack 32 for storing paint containers, an applicator 52, and an instructional brochure 54. The kit 30 has a hinged lid 34 and the lid is provided with a closure 36.

The kit 30 preferably contains at least three containers of paint having the colors yellow, orange and green. In this embodiment, the kit 30 is illustrated having five containers of paint with the colors being yellow, orange, green, red and white. The containers are designated as 42 (yellow), 44 (orange), 46 (green), 48 (red) and 50 (white). It will be appreciated that other colors may be selected according to the needs of a user. An applicator, such as a brush 52 is provided to apply the selected color of paint to the sights 12, 20. Also included is an instruction and information brochure 54.

The sights 12, 20 on the gun 10 are subjected to expansion and contraction due to heat when in use or transport. The sights 12, 20 are also subjected to abrasions from cleaning, use in the field and other causes. The paint selected must therefore be of the type that will aggressively bond to the sights 12, 20 and will withstand the variations in temperature and abrasive contact. The paint is preferably of the type that will expand and contract with the expansion and contraction of the sights 12, 20. SLICK PAINT obtainable from Polymerics Incorporated of Waltham, Mass. is of the type that will aggressively bond to the sights 12, 20 and further has expansion and contraction capabilities to expand and contract with the expansion and contraction of the sights 12, 20.

Those skilled in the art will recognize that modifications and variations may be made without departing from the true spirit and scope of the invention. The invention is therefore not to be limited to the embodiments described and illustrated but is to be determined from the appended claims.

I claim:

1. A method of improving gun sighting for older gun owners which comprises:

producing a coating material of acrylic that securely bonds to metal and expands and contracts with the metal as the metal undergoes expansion and contraction when heated and cooled;

providing multiple coating materials with brilliant coloring, the coloring selected from different colors to provide multiple acrylic material portions, each with a different brilliant color;

said gun owners selecting from among the multiple portions of the acrylic coating material, different portions having different colors and applying said portions to front and rear gun sights mounted on the owner's gun to thereby provide an increased contrast as between the sights and surrounding environ as an aid for aligning said sights of the gun.

* * * * *